US010631580B2

(12) United States Patent
Henry

(10) Patent No.: US 10,631,580 B2
(45) Date of Patent: Apr. 28, 2020

(54) WAISTBAND WITH SUPPORT PANEL

(71) Applicant: NIKE, Inc., Beaverton, OR (US)

(72) Inventor: Ryan P. Henry, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 482 days.

(21) Appl. No.: 15/407,862

(22) Filed: Jan. 17, 2017

(65) Prior Publication Data

US 2018/0199633 A1 Jul. 19, 2018

(51) Int. Cl.

| | |
|---|---|
| ***A41D 1/08*** | (2018.01) |
| ***A41C 1/00*** | (2006.01) |
| ***A41F 9/00*** | (2006.01) |
| ***A41D 1/06*** | (2006.01) |
| ***A41D 27/28*** | (2006.01) |
| ***A41C 1/08*** | (2006.01) |
| ***A41D 31/12*** | (2019.01) |

(52) U.S. Cl.

CPC ..... *A41C 1/003* (2013.01); *A41C 1/08* (2013.01); *A41D 1/06* (2013.01); *A41D 1/08* (2013.01); *A41D 27/28* (2013.01); *A41D 31/12* (2019.02); *A41D 31/125* (2019.02); *A41F 9/00* (2013.01); *A41D 2300/22* (2013.01); *A41D 2400/38* (2013.01); *A41D 2400/82* (2013.01); *A41D 2600/10* (2013.01)

(58) Field of Classification Search

CPC ..... A41D 1/08; A41D 2300/50; A41B 9/02
See application file for complete search history.

(56) References Cited

U.S. PATENT DOCUMENTS

| | | | |
|---|---|---|---|
| 2,682,661 | A | 7/1954 | Kessler |
| 2,779,023 | A | 1/1957 | Lax |
| 3,012,559 | A | 12/1961 | Simon |
| 3,168,099 | A | 2/1965 | Morano |

(Continued)

FOREIGN PATENT DOCUMENTS

| | | | |
|---|---|---|---|
| GB | 2356552 | A | 5/2001 |
| WO | 2009114899 | A1 | 9/2009 |
| WO | 2010132950 | A1 | 11/2010 |

OTHER PUBLICATIONS

"Rago Style 43—Panty Brief Light Shaping," Rago®, rago-shapewear.com, Jul. 8, 2015. https://web.archive.org/web/20150708194446/http://rago-shapewear.com/catalog/product/rago_style_43_-_panty_brief_light_shaping/.

(Continued)

*Primary Examiner* — Richale L Quinn
(74) *Attorney, Agent, or Firm* — Shook, Hardy and Bacon LLP

(57) ABSTRACT

Aspects herein relate to a waistband construct designed to provide support to a torso area of a wearer and more specifically, a mid to lower torso area of a human wearer, (i.e. a pelvic area of a wearer.) The waistband construct in accordance herein may have a multiple modulus of elasticity construction with at least one variation in modulus of elasticity along a circumference of the waistband construct. For example, the waistband construct in accordance with aspects herein may have a first portion having a first modulus of elasticity and a second portion having a second modulus of elasticity, where at least the portion having the higher modulus of elasticity may have a multiple layer construction for providing an effective support mechanism to at least a portion of the mid to lower torso area of the wearer.

14 Claims, 10 Drawing Sheets

(56) References Cited

U.S. PATENT DOCUMENTS

| | | | | |
|---|---|---|---|---|
| 3,285,248 | A | 11/1966 | Williams | |
| 3,322,120 | A * | 5/1967 | Wyss | A41B 9/02 602/67 |
| 4,596,253 | A | 6/1986 | Griffith | |
| 5,217,403 | A | 6/1993 | Nobbs | |
| 5,255,393 | A | 10/1993 | Brady | |
| 5,528,775 | A | 6/1996 | Marenda | |
| 5,535,452 | A | 7/1996 | Rozenblat | |
| 5,876,395 | A | 3/1999 | Hart et al. | |
| 6,023,789 | A | 2/2000 | Wilson et al. | |
| 6,367,086 | B1 | 4/2002 | Woodard | |
| 7,260,961 | B1 | 8/2007 | Kennedy | |
| 7,716,753 | B2 | 5/2010 | Franko | |
| 7,931,639 | B2 | 4/2011 | Suga et al. | |
| 8,375,470 | B2 | 2/2013 | Valentine | |
| 8,784,351 | B2 * | 7/2014 | Dumpson | A41C 1/02 2/401 |
| 9,089,454 | B2 | 7/2015 | Mattingly et al. | |
| 2004/0127876 | A1 | 7/2004 | Stevens | |
| 2016/0044980 | A1 * | 2/2016 | Greenacre | A41D 31/102 2/69 |

OTHER PUBLICATIONS

"Vibe Boxer Modern Fit," SAXX Underwear Co., saxxunderwear.com, SXBM35_HGB, accessed: Jul. 2016. https://www.saxxunderwear.com/us/vibe-boxer-modern-fit-29681.html.

"High Rise," Manshape®, manshape.com, Apr. 30, 2010. http://web.archive.org/web/20100430174715/http://www.manshape.com/.

Liu, Pak-Yiu, et al., "An Ergonomic Flexible Girdle Design for Preteen and Teenage Girls with Early Scoliosis," Journal of Fiber Bioengineering and Informatics 7:2 (2014) 233-246. https://www.researchgate.net/profile/Joanne_Yip/publication/282726626_An ergonomic_flexible_girdle_design_for_preteen_and_teenage_girls_with_early_scoliosis/links/568b16cf08ae051f9afa8d62.pdf.

"Perfect Fit Tapered Leg Trousers," Damart, damart.co.uk, Ref: B666x, accessed: Jul. 2016. http://www.damart.co.uk/F-10058-trousers-w/P-302673-perfect-fit-tapered-leg-trousers?o=true&o=true&o=true&#mrasn=119108.166888.

International Search Report and Written Opinion dated Jul. 5, 2018 in International Patent Application No. PCT/US2018/013961, 19 pages.

International Preliminary Report on Patentability dated Aug. 1, 2019 in U.S. Appl. No. PCT/US2018/013961, 11 pages.

* cited by examiner

WAISTBAND WITH SUPPORT PANEL

CROSS-REFERENCE TO RELATED APPLICATIONS

None.

STATEMENT REGARDING FEDERALLY SPONSORED RESEARCH OR DEVELOPMENT

Not applicable.

TECHNICAL FIELD

Aspects herein relate to waistbands for garments that offer support in a pelvic region of a human body and offer several practical applications in the technical arts, not limited to athletic wear, casual wear, intimate wear and the like.

BACKGROUND OF THE INVENTION

Garments are constructed from different types of materials that have different stretchabilities or elastic characteristics. In aspects, some of these materials may be used to provide support.

BRIEF DESCRIPTION OF THE DRAWINGS

Aspects herein is described in detail below with reference to the attached drawing figures, wherein.

DETAILED DESCRIPTION OF THE INVENTION

Figure 1:
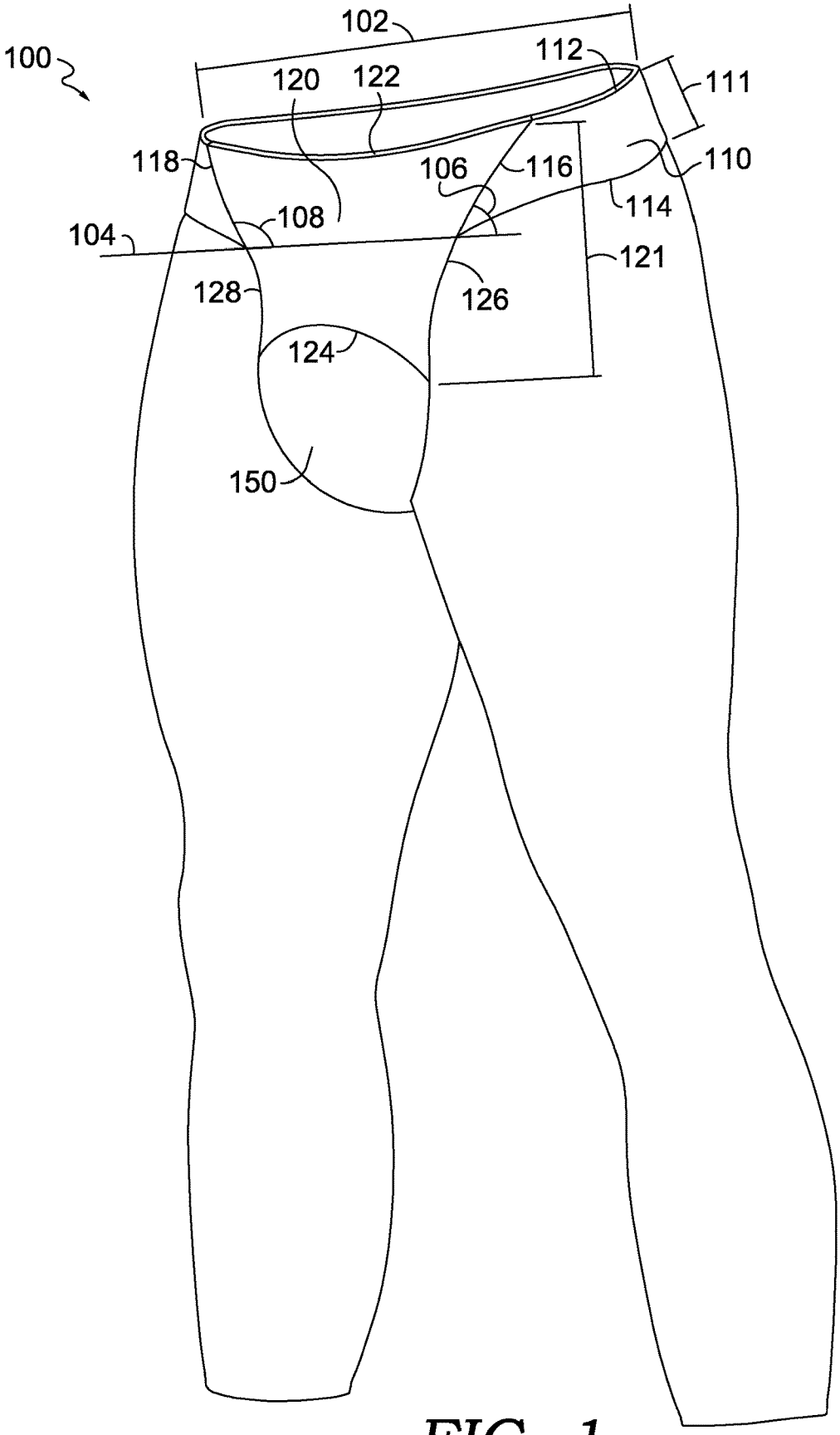
FIG. 1 depicts an exemplary lower body garment incorporating a waistband construct in accordance with aspects herein.

Aspects herein provide for a waistband construct that offers effective support of a torso area and specifically a pelvic area of a wearer. It is to be noted that positional terms used herein such as top, bottom, lateral, front, back, and the like, are with respect to a garment being worn by a hypothetical wearer standing in an anatomical position (i.e. standing straight with feet on the ground or a like surface). For example, a waistband construct for a garment in accordance with the technology described herein may comprise: a first portion having a first modulus of elasticity configured to circumferentially extend around at least a back portion of a wearer when the garment is in an as worn configuration, wherein the first portion may comprise a first end and a second end. The waistband construct may further comprise a second portion having a second modulus of elasticity configured to, at least in part, circumferentially extend around a front portion of the wearer when the garment is in an as worn configuration, wherein the second portion may comprise a first panel of pliable material, a second panel of pliable material, and at least one thermoplastic middle panel positioned between the first panel of pliable material and the second panel of pliable material, wherein the first portion may be secured to the second portion so that the first and the second portions may circumferentially extend around a waist area of the wearer when the garment is in the as-worn configuration.

In another aspect, a method of forming a waistband support panel is disclosed, wherein the method may comprise the steps of: providing a first panel of pliable material having a first perimeter shape defining a first area; providing a first thermoplastic middle panel having a second perimeter shape defining a second area, the first thermoplastic middle panel comprising a plurality of voided portions; providing a second panel of pliable material having a third perimeter shape defining a third area; positioning the first thermoplastic middle panel between the first panel of pliable material and the second panel of pliable material; and applying energy from an energy source to bond together the first panel of pliable material, the first thermoplastic middle panel, and the second panel of pliable material.

In an additional aspect, a support panel for a garment may comprise: an exterior panel of pliable material comprising an interior surface and an exterior surface, a first panel of thermoplastic material comprising a first plurality of voided portions, the first panel of thermoplastic material comprising a first perimeter shape having at least a first top edge and a first bottom edge, defining a first area. Further, the support panel may comprise a second panel of thermoplastic material comprising a second perimeter shape having a second top edge and a second bottom edge, defining a second area, wherein the first area may be greater than the second area and wherein the first top edge of the first panel of thermoplastic material may be aligned with the second top edge of the second panel of thermoplastic material. Furthermore, the support panel may comprise an interior panel of pliable material comprising an interior surface and an exterior surface.

In yet another aspect according to the technology described herein, the waistband construct in accordance herein may comprise a first portion configured to circumferentially extend around at least a back torso area of a wearer and a second portion configured to circumferentially extend around a front torso area of the wearer. Generally, the first portion may have a first modulus of elasticity and the second portion may have a second modulus of elasticity, with the second modulus of elasticity being higher than the first modulus of elasticity. Further, in one aspect, the first portion may be a continuous structure having a first uniform width throughout its length, and the second portion may comprise an overall second width, with the widest point of the second portion defining the overall second width of the second portion. The second width of the second portion may be greater than the first width of the first portion in exemplary aspects.

In another aspect, the first portion of the waistband construct may have multiple widths along its length, with its widest point being configured to align with a spinal area of a wearer to provide an increased support in this area. The first portion in accordance with this aspect may be formed from a continuous piece of material (i.e., no connecting seams attaching two or more pieces of material together) or, it may comprise two or more pieces of material joined together to provide the wider section in the first portion.

The second portion of the waistband construct in accordance with aspects herein may comprise a layered construction with two or more layers. For example, in accordance with aspects herein, the second portion of the waistband construct may comprise a at least one elastomer/thermoplastic panel interposed between two or more panels of pliable material, wherein the elastomer/thermoplastic panel may comprise a elastomer/thermoplastic adhesive layer having a first surface and an opposite second surface, each adhering to a respective panel of pliable material. Further, the elastomer/thermoplastic panel may comprise one or more voided portions. The one or more voided portions may comprise any geometric, auxetic, or organic shape such as for example; circle, square, hexagon, pentagon, auxetic hexagon, bi-lobe, and the like. When more than one voided portion is present, the voided portions may be distributed throughout the elastomer/thermoplastic panel and may be uniform in size throughout, or may vary in size according to their particular location on the elastomer/thermoplastic panel.

In accordance with aspects herein, the one or more voided portions in the elastomer/thermoplastic panel of the second portion may reduce the overall weight of the waistband construct and at the same time, they may provide breathability and increased stretchability to the second portion. This may be especially significant when the waistband construct is provided on a garment that is configured to be in direct contact with a wearer's skin because it will allow for moisture generated from the wearer's body to travel away from the wearer to keep the wearer feeling dry. This feature may increase comfort for the wearer, especially during physical exertion such as, for example, any form of exercise (e.g., walking, running, biking, playing sports, and the like).

For added support, the second portion of the waistband construct may comprise an additional panel(s) of elastomer/thermoplastic material. The additional panel(s) may comprise the same type of elastomer/thermoplastic material as the at least one elastomer/thermoplastic panel described above, or may comprise a different type of thermoplastic material. Furthermore, the additional panel(s) of elastomer/thermoplastic material may comprise a similar or a greater modulus of elasticity than the at least one elastomer/thermoplastic panel described above. The additional panel may comprise a width that is less than the width of the at least one elastomer/thermoplastic panel described above. The additional panel(s) of elastomer/thermoplastic material may be positioned adjacent to a top edge of the second portion of the waistband construct to provide an increased support in an upper area of the second portion of the waistband construct.

In accordance with some aspects herein, the additional panel(s) may also comprise one or more voided portions that may add elasticity and breathability to the second waistband portion. The one or more voided portions of the additional panel(s) may at least partially overlap with the one or more voided portions of the at least one elastomer/thermoplastic panel in the second portion to allow an unobstructed passage of air, moisture, and the like from an interior surface of the second portion of the waistband construct to an exterior surface of the second portion of the waistband construct and vice-versa.

Suitable materials to be used to form the elastomer/thermoplastic panel(s) may include elastomers such as for example, polyurethane-based elastomers such as thermoplastic polyurethane (TPU), silicone-based elastomers, natural rubber-based elastomers, synthetic rubber-based elastomers, and the like.

The panels of pliable material in the second portion of the waistband construct enclosing the elastomer/thermoplastic panel, may comprise the same or similar fabrics/textiles as the overall garment such as, for example, woven or knit fabrics/textiles. The modulus of elasticity of the textiles/fabrics may be greater than the modulus of elasticity of the elastomer/thermoplastic panel, and/or the layering and bonding of the layers of pliable material and the middle panel of the elastomer/thermoplastic panel may effectively increase the modulus of elasticity of the second portion. The elastic properties in the panels of pliable material enclosing the elastomer/thermoplastic panels may be imparted by using, for example, stretchable yarns in the warp direction, in the weft direction, or in both the warp and the weft directions. The stretchable yarns may include, for example elastane yarns, Spandex yarns, Lycra yarns, rubber yarns, and the like. Some stretchable yarns may include a covering of a dyeable material such as cotton, rayon, polyester, nylon, and the like to reduce stickiness, and/or frictional nature of stretchable yarns.

In accordance with aspects herein, the yarns may comprise multiple types of yarns, for example, spun yarns and/or monofilament yarns according to their respective material composition, and/or texture. For example, the woven material in accordance with aspects herein may be capable of undergoing a reversible physical deformation that gives the woven material unique stretch properties in at least the weft direction. Similarly, if a knit material were to be used instead of a woven material, yarns comprising stretchability may be used in combination with yarns having other desired properties to obtain a knit material capable of undergoing a reversible physical deformation in at least an x or y direction. Additionally, different knitting patterns in a knit material may also be used to impart more or less stretchability to the knit material. The different types of yarns may include a combination of synthetic materials (e.g., polyester, rayon, nylon, thermoplastics such as thermoplastic polyurethane, elastomers or elastic materials such as elastane, rubber, and the like), a combination of synthetic materials with natural materials, only natural materials (e.g., cotton, hemp, silk, etc.), and the like. The different yarns may be interwoven with each other to form the stretch-woven material in accordance with aspects herein. For purposes herein, the materials used for weaving are described as yarns; yarns are contemplated to include threads, strings, cords, monofilaments, and the like. Additionally, the yarns in accordance with aspects herein may comprise fibers or filaments that are twisted, braided, spun, melt spun, tangled, and the like, without departing from the aspects described herein. Furthermore, the yarns in accordance with aspects herein may comprise a single material, or in the alternative, the yarns may be multi-portion yarns formed from two or more synthetic, natural, or both synthetic and natural materials.

In another aspect in accordance herein, a method of constructing a support panel is disclosed herein. The method may comprise the steps of providing at least two panels of pliable material such as for example, woven, non-woven, knit, stretch-woven, stretch-knit textiles/fabrics. The first panel of pliable material may be of the same material composition as the second panel of pliable material or, the first panel of pliable material may comprise a different material composition than the second panel of pliable material. Further, the first panel of pliable material may comprise a first perimeter shape defining a first area and the second panel of pliable material may comprise a second perimeter shape defining a second area. The method may further comprise providing a middle panel of an elastomer/thermoplastic material having a third perimeter shape defining a third area. In accordance with an aspect herein, the first perimeter shape and the third perimeter shape may be equal/the same, while the second perimeter shape of the second panel of pliable material may be different than the first perimeter shape and the third perimeter shape. The method may further comprise positioning the middle panel between the first panel and the second panel of pliable material. When aligned, the second panel of pliable material may extend about 5 mm to 25 mm, about 7 mm to 23 mm, about 9 mm to 21 mm, about 11 mm to 19 mm, about 13 mm to 17 mm, or about 12 mm to 15 mm above a top edge of the first panel of pliable material and the middle panel. The extra material extending above the top edge of the first panel of pliable material and the middle panel may be folded over these edges to cover, wrap, or "envelop" the top edges of the first panel of pliable material and the middle panel to provide a smooth edge that is visually appealing and more comfortable when the garment is worn.

The middle panel formed from an elastomer/thermoplastic material interposed between the first panel of pliable material and the second panel of pliable material may comprise inherent adhesive properties or, alternatively, may comprise an adhesive coating on one or both surfaces of the middle panel that when activated via, for instance, heat energy or ultrasonic energy, may bond the first panel of pliable material and the second panel of pliable material. In accordance with one aspect, prior to activating the adhesive properties of the middle panel or the adhesive applied thereon, the middle panel may be provided with one or more voided portions. The one or more voided portions may be distributed throughout the middle panel or they may be concentrated in particular areas of the middle panel such as, for example, a center region of the middle panel, a top region of the middle panel (adjacent to a top edge), or a bottom region of the middle panel to increase breathability of the second portion of the waistband construct.

When more than one voided portion is present, the voided portions may comprise different shapes and/or sizes in different areas of the middle panel. For example, a first voided portion in a first area of the middle panel may comprise a first shape and/or size and a second voided portion in a second area of the middle panel may comprise a second shape and/or size. Alternatively, the voided portions may be provided in a uniform shape and/or size throughout the middle panel.

As described above, the second portion of the waistband construct may further comprise a second middle panel of an elastomer/thermoplastic material. The second middle panel may comprise a higher modulus of elasticity than the first middle panel, or it may comprise the same modulus of elasticity as the first middle panel. The second middle panel may comprise a fourth perimeter shape enclosing or defining a fourth area. The fourth area defined by the fourth perimeter shape may be smaller than the third area defined by the third perimeter shape. In one aspect, the width of the second middle panel may correspond to the width of the first portion of the waistband construct and may be positioned adjacent to the top edge of the second portion to form a continuous band with the first portion. This may allow for a tighter support in an area corresponding to a top section of the second portion and provide a familiar waistband feel to the wearer, when the waistband construct is incorporated in a garment worn by a wearer.

If the second middle panel is incorporated, the second middle panel may be incorporated prior to applying energy to the second portion to activate the first and second middle panels or adhesives applied thereon to adhere together the first panel of pliable material, the first middle panel, the second middle panel, and the second panel of pliable material. The second middle panel, in accordance to aspects herein, similar to the first middle panel, may also comprise one or more voided portions to provide more stretchability and breathability to the second portion. The one or more voided portions in the second middle panel may overlap, at least in part, with the one or more voided portions in the first middle panel as to not to obstruct the airflow between an interior and an exterior of the garment incorporating the waistband construct in accordance with aspects herein.

In accordance with further aspects, the first portion and the second portion of the waistband construct may be connected to each other through seams formed by stitching and/or adhesive bonding. In general, the constructed second portion of the waistband construct may comprise a shape equal to the first perimeter shape of the first panel of pliable material. The shape of the second portion may comprise at least a top edge, a bottom edge and two lateral edges. The top edge, the bottom edge and the two lateral edges may be straight edges, curvilinear edges, or a combination of both (e.g., two straight lateral edges and a curvilinear top edge, and a curvilinear bottom edge). The lateral edges may be vertical (i.e., perpendicular to a horizontal plane cutting through any point on the second portion, or may form an angle with the horizontal plane). For example, a first lateral edge may form a 30° angle and the opposite second lateral edge may form a 150° angle with the horizontal plane. It is to be noted that any angle may be formed between 1° to 90° for the first lateral edge and a corresponding 90° to 179° for the opposite second lateral edge, or vice versa. Furthermore, the first portion may comprise two ends, a first end to be secured to the first lateral edge of the second portion and a second end to be secured to the second lateral edge of the second portion. The first end may be angled to complement any angles associated with the first lateral edge, and the second end may also be angled to complement any angles associated with the second lateral edge.

As presented above, the first portion and the second portion may be secured to each other through seams formed by stitching and/or adhesive bonding. When adhesively bonding the first portion to the second portion, the first end and the second end of the first portion may be configured to extend into the second portion. In other words, a portion of the first end may be interposed between the first panel of pliable material and the first and/or second middle panel of elastomer/thermoplastic material and, a portion of the second end may be interposed between the first panel of pliable material and the first and/or second middle panel of elastomer/thermoplastic material. In order to provide a smooth transition between the first portion and the second portion, the surface of the first portion not in direct contact with the first middle panel of elastomer/thermoplastic material may be provided with an adhesive layer to bond both surfaces of the first portion to the first panel of pliable material and the first middle panel of elastomer/thermoplastic material. Alternatively, the first end of the first portion may be interposed between the second panel of pliable material and the first or second middle panel of pliable material, or between the first middle panel and the second middle panel. Similarly, the second end of the first portion may be interposed between the second panel of pliable material and the first or second middle panel of pliable material, or between the first middle panel and the second middle panel.

If stitched, an edge of the first end of the first portion may be configured to abut the first lateral edge of the second portion and an edge of the second end of the first portion may be configured to abut the second lateral edge of the second portion, thereby forming a substantially flat seam transition. Both of the stitched seams may be further reinforced by applying a strip of a woven or non-woven material having adhesive properties on at least one surface of the stitched seams to conceal the stitching underneath the strip of woven or non-woven material. In addition to reinforcing and concealing the seams, the strip of woven or non-woven material serves to provide a smooth surface to minimize pressure points caused by the seams securing the first portion and the second portion of the waistband construct in accordance with aspects herein.

Further aspects will be made clearer with reference to the figures, as hereinafter set forth. For example, FIG. 1 depicts an exemplary lower body garment 100 incorporating a waistband construct 102 in accordance with aspects herein. The lower body garment 100 as shown, although depicted extending below a calf area of a wearer, the lower body garment 100 can be of any length desired such as, for example, short pants extending above a knee area of a wearer, capri length, and the like. As shown, the lower body garment 100 is a fitted lower body garment configured to closely conform to a wearer's body when the lower body garment 100 is worn by the wearer.

The waistband construct 102 may comprise at least a first portion 110 and a second portion 120. The first portion 110 may be configured to circumferentially extend around at least a back torso area of a wearer when the lower body garment 100 is worn and the second portion 120 may be configured to circumferentially extend around at least a portion of the front torso area of a wearer, and more specifically, a pelvic area of a wearer when the lower body garment 100 is worn.

In exemplary aspects, the first portion 110 comprises a first width 111 and a first modulus of elasticity. The first width 111 of the first portion 110 is defined by an upper edge 112 and a lower edge 114. The first width 111 of the first portion 110 may range between 1-10 cm, 2-9 cm, 3-8 cm, 4-7 cm, 5-6 cm, and the like. The first portion 110 may comprise a stretch-knit or a stretch-woven construction. The first portion 110 may be secured to the second portion 120 near a first end 116 of the first portion 110 and a second end 118 of the first portion 110. As will become more apparent with reference to FIGS. 2A-2C, there may be several ways of securing the first portion 110 to the second portion 120.

In exemplary aspects, the second portion 120 comprises a second width 121 and a second modulus of elasticity. The second modulus of elasticity of the second portion 120 may be higher than the first modulus of elasticity of the first portion 110, thereby generally providing a tighter support than the first portion 110. The second width 121 of the second portion 120, as shown, may be defined by an upper edge 122 and a lower edge 124. In exemplary aspects, the second width 121 of the second portion 120 may be constant throughout its length, wherein the length of the second portion 120 may be defined by a first lateral edge 126 and an opposite second lateral edge 128, or may vary at different portions of its length, depending on the shape of the upper edge 122 and the lower edge 124. The upper edge 122 and the lower edge 124 are shown as being curvilinear, however, the upper edge 122 and the lower edge 124 may take on any shape suitable for the construction of the waistband construct 102 such as, for example, linear (i.e., straight lines), curvilinear (as shown), wave pattern, dented pattern, and the like. The curvilinear shape of the upper edge 122 and the lower edge 124 may be advantageous for providing focused support to desired points of the front pelvic area (i.e., lower abdomen) of a wearer while providing comfortable support to other points of the pelvic area of the wearer where a higher level of support may not be necessary or undesirable such as, for example, garment portion 150. The second width 121 of the second portion 120 may, for example, range between 5-30 cm, 8-27 cm, 10-25 cm, 12-23 cm, 14-19 cm, 13-18 cm, and the like.

The first lateral edge 126 of the second portion 120 may abut, in part the first end 116 of the first portion 110 and the second lateral edge 128 of the second portion 120 may abut, in part the second end 118 of the first portion 110. In exemplary aspects, the first lateral edge 126 may form a first angle 106 with a horizontal plane 104 cutting through any point on the second portion 120, and the second lateral edge 128 may form a second angle 108 with the horizontal plane 104 cutting through the same point on the second portion 120. The first angle 106 and the second angle 108 may be between 1° to 179° with respect to the horizontal plane 104. The first angle 106 and the second angle 108 may be complementary adding up to 180°. In other words, if the first angle 106 is 30°, for example, the second angle 108 will be 160° to form an overall symmetrical perimeter shape for the second portion 120. Further, depending on where the horizontal plane 104 is provided, the first angle 106 and the second angle 108 may remain the same along the first lateral edge 126 and the second lateral edge 128, or the first angle 106 and the second angle 108 may be varied along the first lateral edge 126 and the second lateral edge 128 (e.g., the first angle 106 and second angle 108 may become closer to a 90° angle adjacent to the lower edge 124 as opposed to upper edge 122, as shown.)

The first portion 110 may be secured to remaining portions of the lower body garment 100 by lower edge 114 by one or more methods including, for example, stitching, adhesive bonding, welding, and the like. The second portion 120 may be secured to remaining portions of the lower body garment 100 by lower edge 124 and at least a portion of the first lateral edge 126 and at least a portion of the second lateral edge 128 by one or more methods, including, for example, stitching, adhesive bonding, welding and like. If stitching is used, the stitching employed may be flat-stitching so that there are no bulky transitions at the seam areas, thereby improving the comfortable wear, especially when the garments are body fitting garments, such as, for example, lower body garment 100.

Figure 2A:
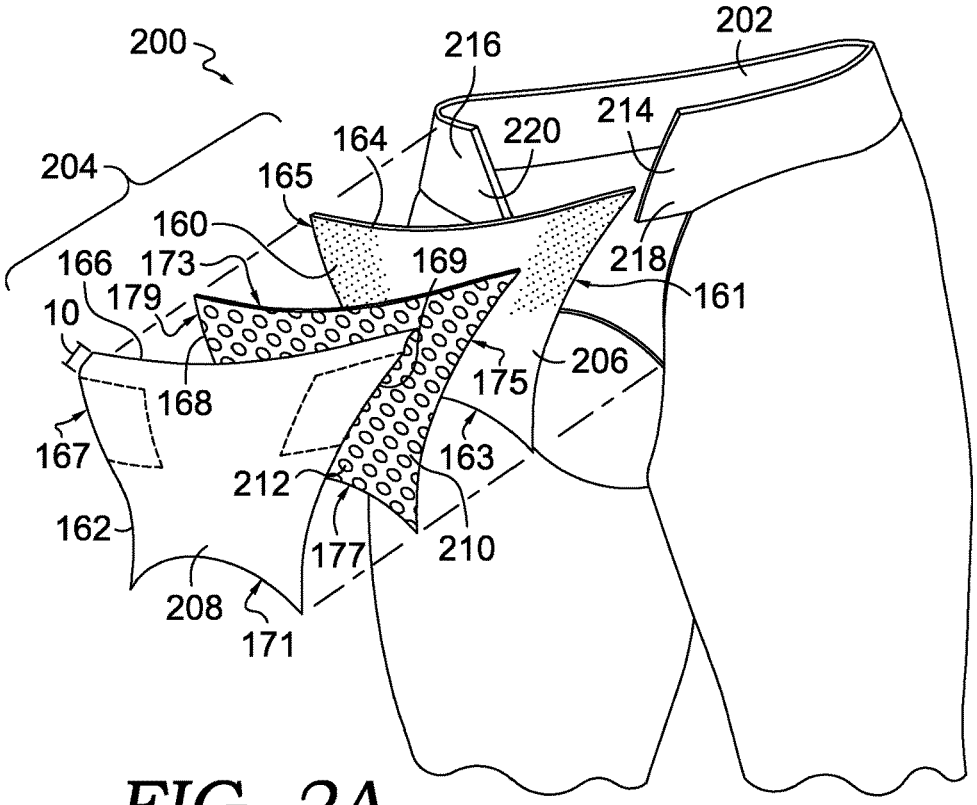
FIG. 2A depicts an exploded view of an exemplary configuration for a second portion of the waistband construct in accordance with aspects herein.

Moving on to FIGS. 2A-2D, exploded views of different exemplary waistband constructs in accordance with aspects herein are shown. FIG. 2A, for example, depicts a lower body garment 200 with a waistband construct in accordance with aspects herein having a first portion 202 and a second portion 204. In FIG. 2A, an exploded view of an exemplary configuration for the second portion 204 is shown. The second portion 204, as briefly described above, may comprise a first panel of pliable material 206, a second panel of pliable material 208, and a middle panel 210 of an elastomer/thermoplastic material interposed or positioned between the first panel of pliable material 206 and the second panel of pliable material 208. The middle panel 210 may comprise one or more voided portions 212 (i.e., openings). The one or more voided portions 212 may be uniformly distributed throughout the middle panel 210 (as shown here and FIG. 3A), or the one or more voided portions 212 may be different in size and/or shape in different areas of the middle panel 210, as shown in FIG. 3B, where, for example, larger voided portions may be provided at areas where increased breathability and elasticity are desired, as opposed to other areas where less breathability is required or, where more support is desired.

The first panel of pliable material 206 and the second panel of pliable material 208 may comprise the same woven/knit, stretch woven/knit, or non-woven material as the rest of the lower body garment 200. For example, the lower body garment 200 may be constructed from a stretch-woven fabric/textile comprising at least a 2% by weight of an elastic yarn (fibers, monofilaments, and the like are also envisioned in accordance with aspects herein) such as elastane, polyurethane, silicone, rubber, and the like. The stretch-woven fabric/textile may comprise a first modulus of elasticity providing a first level of support to a wearer's lower body when the lower body garment 200 is worn. Alternatively, the first panel of pliable material 206 and the second panel of pliable material 208 may comprise a different woven/knit, stretch woven/knit, or non-woven material from the rest of the lower body garment 200. For example, the first panel of pliable material 206, as depicted, may be an interior panel configured to face a wearer when the lower body garment 200 is worn, while the second panel of pliable material 208, as depicted, may be an exterior panel configured to face an outer environment when the lower body garment 200 is worn. Since the first panel of pliable material 206 is an interior panel with the greatest proximity to the wearer's body, the first panel of pliable material 206 may comprise a moisture management fabric/textile configured to pull moisture (i.e., perspiration) away from the wearer's body and provide a dry feeling to the wearer when the lower body garment 200 is worn. In the same spirit, the second panel of pliable material 208 may comprise a fabric/textile that allows quick evaporation of moisture to promote the dry feeling and comfort of the wearer when the lower body garment 200 is worn.

Further, the first panel of pliable material 206 may comprise a first perimeter shape 160 defining an overall shape of the second portion 204, the first perimeter shape 160 comprising at least a first/top edge 164, a second edge 161, a third edge 163, and a fourth edge 165. Similarly, the second panel of pliable material 208 may comprise a second perimeter shape 162 that may be substantially the same as the first perimeter shape 160 of the first panel of pliable material 206, or alternatively the second perimeter shape 162 of the second panel of pliable material 208 may be larger (or occupy a greater surface area) than the first perimeter shape 160 of the first panel of pliable material 206, the second perimeter shape comprising at least a first/top edge 166, a second edge 167, a third edge 169 and a fourth edge 171. The larger second perimeter shape 162 may allow, for example, at least a portion of the second edge 167, a portion of the third edge 169 and the first/top edge 166 of the second panel of pliable material 208 to be wrapped over at least first/top edge 164 of the first panel of pliable material 206 and/or first/top edge 173 of the middle panel 210. For example, a first/top edge 166 of the second panel of pliable material 208 may extend a distance 10 above a first/top edge 164 of the first panel of pliable material 206.

The middle panel 210, as described above, may comprise a third perimeter shape 168 that is substantially similar to the first perimeter shape 160 of the first panel of pliable material 206, the third perimeter shape comprising at least a first/top edge 173, a second edge 175, a third edge 177, and a fourth edge 179. Further, the middle panel 210 may be comprised of an elastomer/thermoplastic material that may inherently comprise adhesive properties when activated with energy (e.g., heat, ultrasonic, and the like), or the middle panel 210 may be provided with a coating of an energy-sensitive adhesive on both surfaces of the middle panel 210 so that, when activated, all three layers (i.e., the first panel of pliable material 206, middle panel 210, and the second panel of pliable material 208) may become integrally bonded to each other to form the second portion 204 of the waistband construct for the lower body garment 200, in accordance with aspects herein.

The first portion 202 and the second portion 204 may be secured to each other by interposing a first segment 218 of the first end 214 and a second segment 220 of the second end 216 of the first portion 202 between the first panel of pliable material 206 and the middle panel 210, or between the second panel of pliable material 208 and the middle panel 210. The surfaces of the first segment 218 and second segment 220 not in direct contact with the middle panel 210, may be provided with an adhesive to ensure bonding of the first segment 218 and the second segment 220 to the first panel of pliable material 206 or the second panel of pliable material 208, respectively. The bonds securing the first portion 202 to the second portion 204 of the waistband construct may optionally be further reinforced by stitching.

Figure 2B:
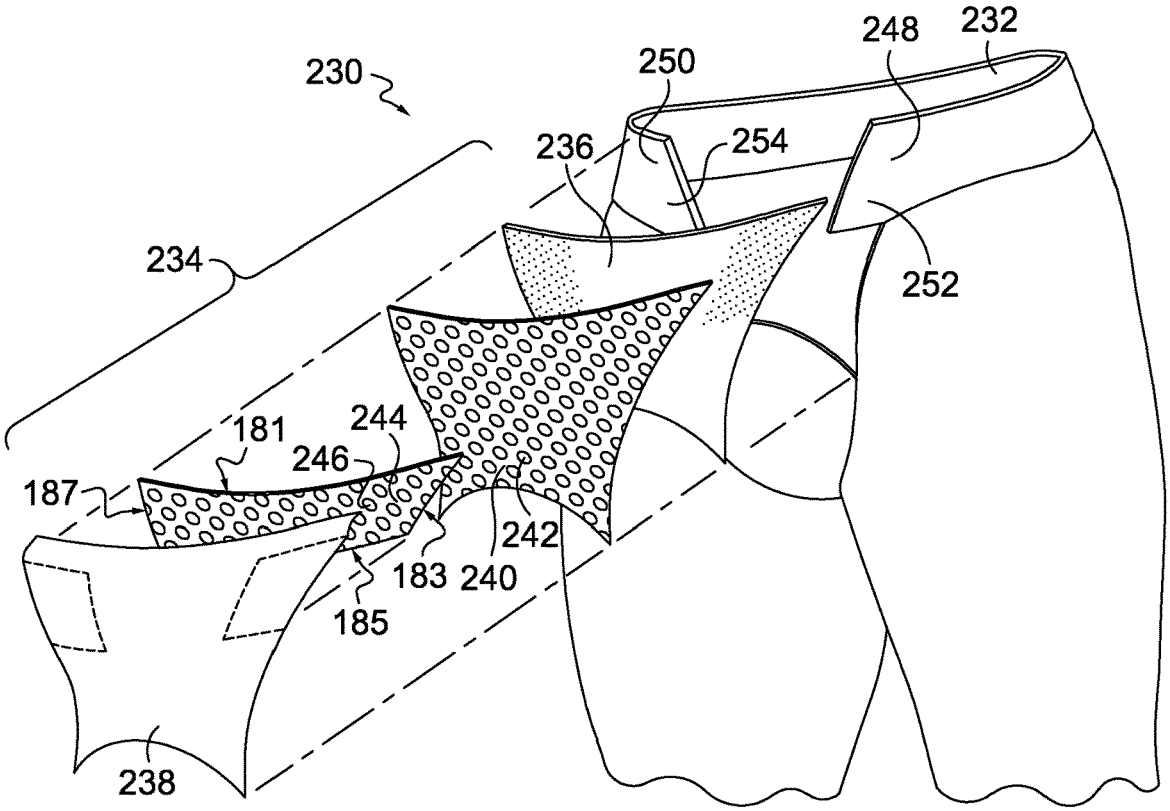
FIG. 2B depicts an exploded view of another exemplary configuration for the second portion of the waistband construct in accordance with aspects herein.

Moving on to FIG. 2B, a similar exploded view of another exemplary configuration for a second portion 234 for a waistband construct for a lower body garment 230 is shown. The second portion 234, as briefly described above, may comprise a first panel of pliable material 236, a second panel of pliable material 238, a first middle panel 240 of an elastomer/thermoplastic material and a second middle panel 244 interposed between the first panel of pliable material 236 and the second panel of pliable material 238. The first middle panel 240 may comprise one or more voided portions 242 (i.e., openings) and the second middle panel 244 may also comprise one or more voided portions 246. The one or more voided portions 242 and 246 may be uniformly distributed throughout the first middle panel 240 and the second middle panel 244, respectively (as shown here and FIG. 3A), or the one or more voided portions 242 and 246 may comprise different sizes and/or shapes in different areas of the first middle panel 240 and the second middle panel 244, (as shown in FIG. 3B) where, for example, larger voided portions may be provided at areas where increased breathability and elasticity are desired, as opposed to other areas where less breathability and/or stretchability is required or, where more support is desired.

As in the lower body garment 200, the first panel of pliable material 236 and the second panel of pliable material 238 of the lower body garment 230 may comprise the same woven/knit, stretch woven/knit, or non-woven material as the rest of the lower body garment 230. For example, the lower body garment 230 may be constructed from a stretch-woven fabric/textile comprising at least a 2% by weight of an elastic yarn (fibers, monofilaments, and the like are also envisioned in accordance with aspects herein) such as elastane, polyurethane, silicone, rubber, and the like. The stretch-woven fabric/textile may comprise a first modulus of elasticity providing a first level of support to a wearer's lower body when the lower body garment 230 is worn. Alternatively, the first panel of pliable material 236 and the second panel of pliable material 238 may comprise a different woven/knit, stretch woven/knit, or non-woven material from the rest of the lower body garment 230. For example, the first panel of pliable material 236, as depicted, is an interior panel configured to face a wearer when the lower body garment 230 is worn, while the second panel of pliable material 238, as depicted, is an exterior panel configured to face an outer environment when the lower body garment 230 is worn. Since the first panel of pliable material 236 is an interior panel with the greatest proximity to the wearer's body, the first panel of pliable material 236 may comprise a moisture management fabric/textile configured to rapidly pull moisture (i.e. perspiration) away from the wearer's body to provide a dry feeling to the wearer when the lower body garment 230 is worn. In the same spirit, the second panel of pliable material 238 may comprise a fabric/textile that allows quick evaporation of moisture to promote the dry feeling and comfort of the wearer when the lower body garment 230 is worn.

Both the first middle panel 240 and the second middle panel 244 may be comprised of an elastomer/thermoplastic material that may inherently comprise adhesive properties when activated with energy (e.g., heat, ultrasonic, and the like), or the first middle panel 240 and/or the second middle panel 244 may be provided with a coating of an energy-sensitive adhesive on one or both surfaces of the first middle panel 240 and the second middle panel 244 so that, when activated, all four layers (i.e., the first panel of pliable material 236, first middle panel 240, the second middle panel 244, and the second panel of pliable material 238) may become integrally bonded to each other to form the second portion 234 of the waistband construct for the lower body garment 230, in accordance with aspects herein.

The first middle panel 240 may be distinct or different from the second middle panel 244. For example, the second middle panel 244 may be narrower than the first middle panel 240 and may be defined by a fourth perimeter shape, the fourth perimeter shape comprising at least a first/top edge 181, a second edge 183, a third edge 185, and a fourth edge 187. In some aspects, the second middle panel 244 may comprise a width that is substantially similar to the width of the first portion 232 of the waistband construct of the lower body garment 230. This feature may provide the feeling of a continuous waistband to the wearer when the lower body garment 230 is worn. Further, the second middle panel 244 may provide additional support to the second portion 234.

The first portion 232 and the second portion 234 may be secured to each other by interposing a first segment 248 of a first end 252 of the first portion 232 and a second segment 250 of a second end 254 of the first portion 232 between the first panel of pliable material 236 and the first middle panel 240, or between the first middle panel 240 and the second middle panel 244, or between the second panel of pliable material 238 and the second middle panel 244. Any and all aspects, and any variation thereof, are contemplated as being within aspects herein. The surfaces of the first segment 248 and the second segment 250 not in direct contact with the first middle panel 240 or the second middle panel 244, may be provided with an adhesive to ensure bonding of the first segment 248 and the second segment 250 of the first portion 232 to the first panel of pliable material 236 or the second panel of pliable material 238, respectively. Further, the bonds securing the first portion 232 to the second portion 234 of the waistband construct may optionally be reinforced by stitching (not shown). As shown in FIG. 2B, the first middle panel 240 may be located adjacent to the first panel of pliable material 236, and the second middle panel 244 may be located adjacent to the second panel of pliable material 238. However, it is contemplated that the positions of the first middle panel 240 and the second middle panel 244 may be interchanged so that the first middle panel 240 is located adjacent to the second panel of pliable material 238, and the second middle panel 244 is located adjacent to the first panel of pliable material 236.

Figure 2C:
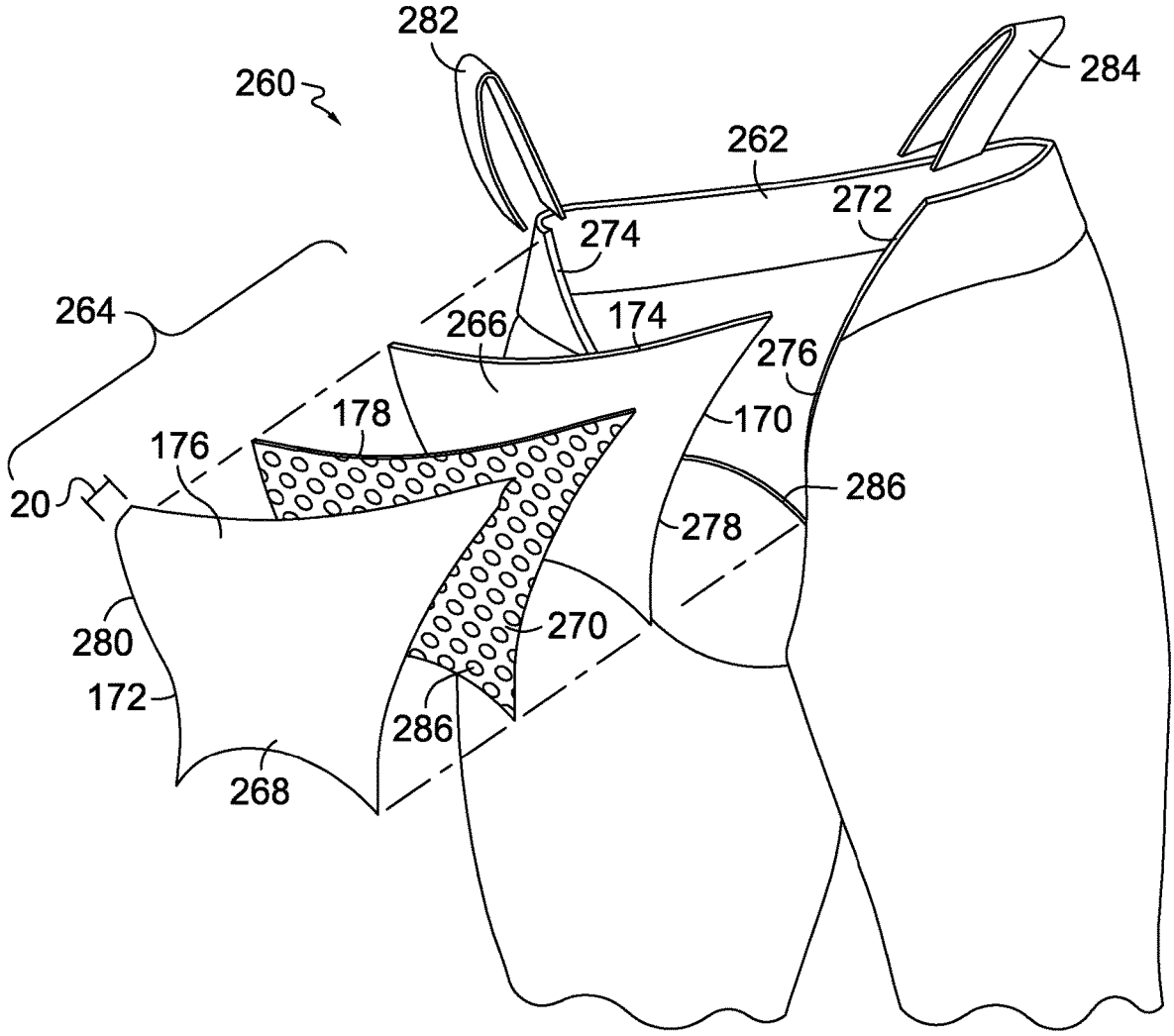
FIG. 2C depicts an exploded view of a different exemplary configuration for the second portion of the waistband construct in accordance with aspects herein.

Moving on to FIG. 2C, a different exemplary configuration of a waistband construct in accordance with aspects herein, is disclosed. Similar to FIG. 2A, a lower body garment 260 with a waistband construct in accordance with aspects herein having a first portion 262 and a second portion 264 is shown. In FIG. 2C, an exploded view of an exemplary configuration for the second portion 264 is shown. The second portion 264, as briefly described above, may comprise a first panel of pliable material 266, a second panel of pliable material 268, and a middle panel 270 of an elastomer/thermoplastic material interposed between the first panel of pliable material 266 and the second panel of pliable material 268. The middle panel 270 may comprise one or more voided portions 286 (i.e. openings). The one or more voided portions 286 may be uniformly distributed throughout the middle panel 270, or the one or more voided portions 286 may be different in size and/or shape in different areas of the middle panel 270 where, for example, larger voided portions may be provided at areas where increased breathability and elasticity are desired, as opposed to other areas where less breathability is required or, where more support is desired.

The first panel of pliable material 266 and the second panel of pliable material 268 may comprise the same woven/knit, stretch woven/knit, or non-woven material as the rest of the lower body garment 260. Aspects describing the second portion 264 of the lower body garment 260 may be similar or the same as those described above with respect to FIGS. 2A and 2B. As such, for brevity's sake, those aspects will not be reiterated here. For example, a stretch-woven fabric/textile may be used in accordance with aspects herein, wherein the stretch-woven fabric/textile may comprise a first modulus of elasticity providing a first level of support to a wearer's lower body when the garment is worn. Alternatively, the first panel of pliable material 266 and the second panel of pliable material 268 may comprise a different woven/knit, stretch woven/knit, or non-woven material from the rest of the lower body garment 260. For example, the first panel of pliable material 266, as depicted, is an interior panel configured to face a wearer when the lower body garment 260 is worn, while the second panel of pliable material 268, as depicted, is an exterior panel configured to face an outer environment when the lower body garment 260 is worn. Since the first panel of pliable material 266 is an interior panel with the greatest proximity to the wearer's body, the first panel of pliable material 266 may comprise a moisture management fabric/textile configured to rapidly pull moisture (i.e. perspiration) away from the wearer's body to provide a dry feeling to the wearer when the lower body garment 260 is worn. In the same spirit, the second panel of pliable material 268 may comprise a fabric/textile that allows quick evaporation of moisture to promote the dry feeling and comfort of the wearer when the lower body garment 260 is worn.

Similar to FIGS. 2A and 2B, in FIG. 2C, the first panel of pliable material 266 may comprise a first perimeter shape 170 defining an overall shape of the second portion 264. Similarly, the second panel of pliable material 268 may comprise a second perimeter shape 172 that may be substantially the same as the first perimeter shape 170 of the first panel of pliable material 266, or alternatively, the second perimeter shape 172 of the second panel of pliable material 268 may be larger than the first perimeter shape 170 of the first panel of pliable material 266 such that, for example, the second panel of pliable material 268 may extend over and be wrapped over the first panel of pliable material 266 and the middle panel 270. For example, a first/top edge 176 of the second panel of pliable material 268 may extend a distance 20 above a first/top edge 174 of the first panel of pliable material 266.

The middle panel 270 may comprise a third perimeter shape 178 that is substantially similar to the first perimeter shape 170 of the first panel of pliable material 266. The middle panel 270 may be comprised of an elastomer/thermoplastic material that may inherently comprise adhesive properties when activated with energy (e.g., heat, ultrasonic, and the like), or the middle panel may be provided with a coating of an energy sensitive adhesive on both surfaces of the middle panel 270 so that, when activated, all three layers (i.e., the first panel of pliable material 266, middle panel 270, and the second panel of pliable material 268) may become integrally bonded to each other to form the second portion 264 of the waistband construct for the lower body garment 260, in accordance with aspects herein.

The first portion 262 and the second portion 264 may be secured to each other by forming seams through stitching (e.g. flat stitching) or otherwise bonding, in part, a first edge 272 of the first portion 262 to a first lateral edge 278 of the second portion 264 and a second edge 274 of the first portion 262 to a second lateral edge 280 of the second portion 264. In other words, the first edge 272 may be configured to abut, in part, the first lateral edge 278 of the second portion 264, and similarly, the second edge 274 may be configured to abut, in part, the second lateral edge 280 of the second portion 264. Further, as shown, the remaining portions of the first lateral edge 278 and the second lateral edge 280 of the second portion 264, are configured to abut, in part, the layers/panels forming the lower body garment 260, for example at edge 276. The seams securing the first portion 262 and the second portion 264 may be further reinforced by applying reinforcement layers 282 and 284, respectively to cover up the seams securing the first portion 262 and the second portion 264 to each other and the rest of the lower body garment 260. The reinforcement layers 282 and 284 may comprise, for example, strips of natural or synthetic fabrics coated with an adhesive on one surface, or the reinforcement layers 282 and 284 may comprise strips of synthetic material that when bonded, form a strong bond with the textile forming the lower body garment 260. Additionally, the reinforcement layers 282 and 284 may allow for a smooth transition between the first portion 262 and the second portion 264 for a more comfortable wear feel for a wearer when the lower body garment 260 is in an as-worn configuration.

It is contemplated that similar to the example shown in FIG. 2B, the exemplary lower body garment 260 in FIG. 2C, may further comprise an additional middle panel (not shown). The additional middle panel may, for example, be narrower than the middle panel 270 to coincide with the width of the first portion 262, and may comprise its own set of one or more voided portions. The one or more voided portions in the additional middle panel may be configured to align, at least in part, with the one or more voided portions 286 of the middle panel 270, as to not obstruct the fluid communication between an interior and an exterior of the lower body garment 260 through the second portion 264 when the lower body garment 260 is worn.

Figure 3A:
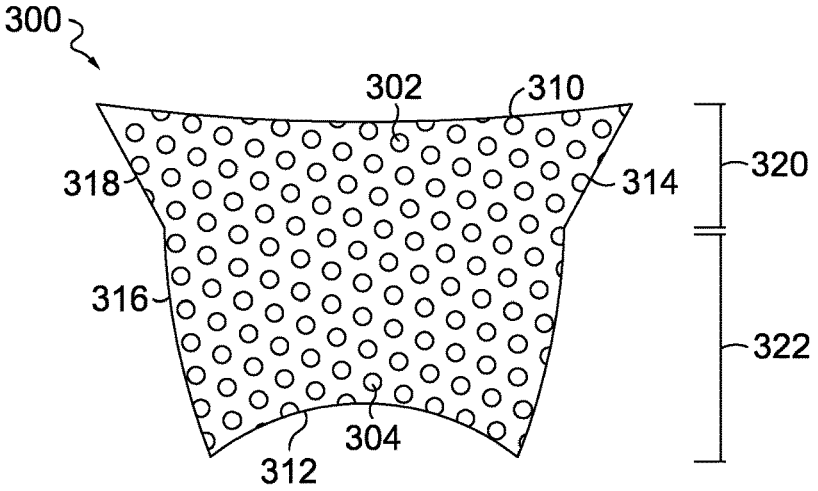
FIG. 3A depicts an exemplary middle panel of the second portion of the waistband construct where the middle panel comprises one or more voided portions of uniform size evenly distributed throughout the middle panel in accordance with aspects herein.
Figure 3B:
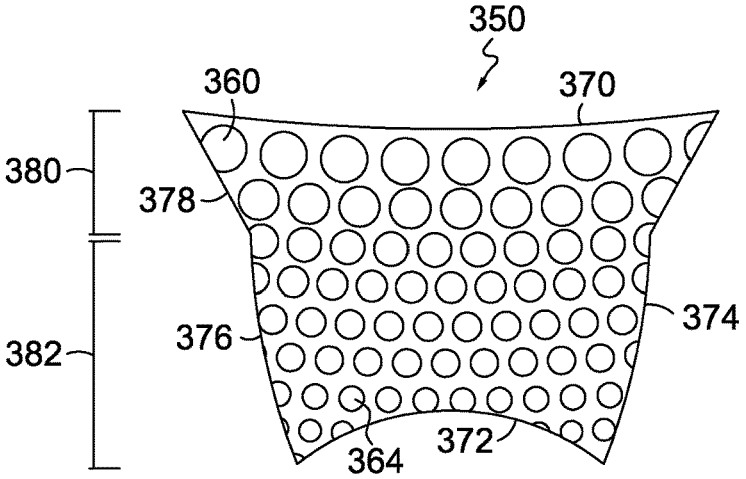
FIG. 3B depicts an exemplary middle panel of the second portion of the waistband construct where the middle panel comprises one or more voided portions of different sized distributed throughout the middle panel in accordance with aspects herein.

Moving on to FIGS. 3A and 3B, exemplary configurations for the one or more voided portions in the middle panel(s) comprising elastomer/thermoplastic materials are shown. For example, middle panel 300 in FIG. 3A may comprise a perimeter shape 318 that substantially corresponds to a final shape of the second portion of the waistband construct in accordance with aspects herein. The perimeter shape 318 may be generally defined by a top edge 310, a bottom edge 312, a first lateral edge 316, and a second lateral edge 314. The top edge 310, the bottom edge 312, the first lateral edge 316, and the second lateral edge 314 may be linear (e.g. straight lines), curvilinear (e.g. top edge 310 and bottom edge 312), or a combination of both (e.g. each of the first lateral edge 316 and the second lateral edge 314 may be comprised of a linear portion 320 and a curvilinear portion 322.) Further, as shown, the middle panel 300 may comprise one or more voided portions distributed throughout the surface area of the middle panel 300. Each of the one or more voided portions may be the same shape and size, as shown. For example, a first voided portion 302 located near the top edge 310 may comprise a first size and shape, and a second voided portion 304 located closer to the bottom edge 312 may comprise a second size and shape that is substantially the same as the first size and shape. The size, shape and number of voided portions may be determined based on the needed structural integrity of the middle panel 300, the amount of airflow desired, the amount of stretch desired, the amount of support desired, and the like. The support and stretchability of the middle panel 300 may be inversely proportional such that, for example, with the more voided portions present on the middle panel 300, the level of stretch may be increased while the level of support may be decreased.

Moving on to FIG. 3B, a different configuration for a middle panel 350 is shown. For example, the middle panel 350 may comprise a perimeter shape 378 that, similar to perimeter shape 318, substantially corresponds to a final shape of the second portion of the waistband construct in accordance with aspects herein. The perimeter shape 378 may be generally defined by a top edge 370, a bottom edge 372, a first lateral edge 376, and a second lateral edge 374. The top edge 370, the bottom edge 372, the first lateral edge 376, and the second lateral edge 374 may be linear (e.g. straight lines), curvilinear (e.g. top edge 370 and bottom edge 372), or a combination of both (e.g. each of the first lateral edge 376 and the second lateral edge 374 may be comprised of a linear portion 380 and a curvilinear portion 382.) Further, as shown, the middle panel 350 may comprise one or more voided portions distributed throughout the surface area of the middle panel 350. Each of the one or more voided portions may have a different shape and/or size, as shown. For example, a first voided portion 360 located near the top edge 370 may comprise a first size and shape, and a second voided portion 364 located closer to the bottom edge 372 may comprise a second size and shape that is different than the first size and shape of the first voided portion 360. In the middle panel 350, for example, the first voided portion 360 is relatively bigger than the second voided portion 364 with intermediately sized voided portions in between, thereby creating a size gradient. A size gradient may be useful in accordance with aspects herein because different body parts of a wearer tend to have different levels of perspiration. Therefore, the larger voided portions may be strategically placed near the areas of the second portion of the waistband construct configured to align with the body areas of a wearer with the higher levels of perspiration. As described above, however, the size, shape and number of voided portions may be determined based on the needed structural integrity of the middle panel 350, the amount of airflow desired, the amount of stretch desired, the amount of support desired, and the like. It is to be noted that although in FIG. 3B, the size gradient is shown as being top-down, it is contemplated that the gradient may be in any desired direction for example, side-to-side, diagonal, edge-to-center, bottom-to-top, center-to-edge, and the like.

Figure 4A:
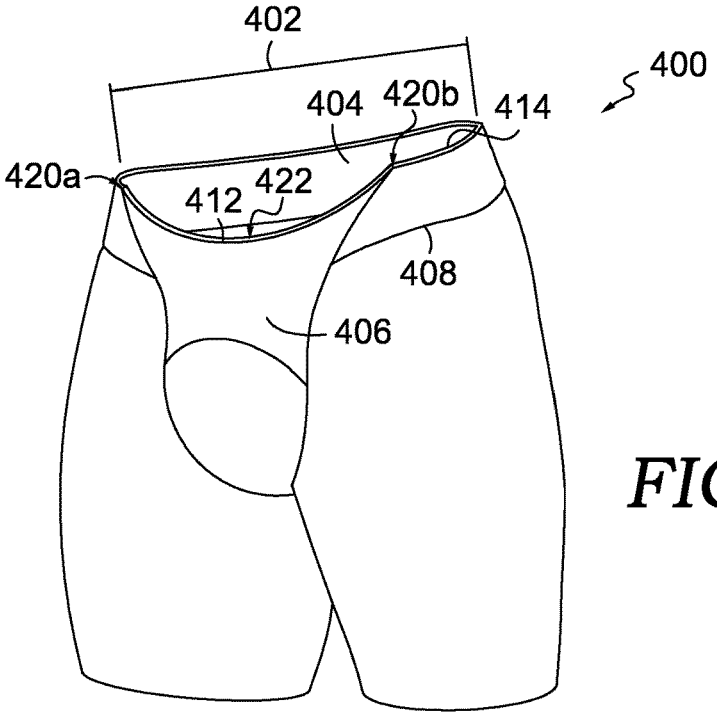
FIG. 4A depicts an exemplary lower body garment incorporating a waistband construct in accordance with aspects herein.

In FIG. 4A an exemplary garment 400 comprising a waistband construct in accordance with aspects herein is shown. Similar to the garment discussed above with reference to FIG. 1, the garment 400 generally comprises a waistband construct 402 comprising a first portion 404 configured to circumferentially extend around the back waist area of a wearer when the garment 400 is worn, and a second portion 406 configured to circumferentially extend around a front pelvic area of a wearer when the garment 400 is worn. In the garment 400, the first portion 404 comprises a top edge 414 that may be straight throughout, and the second portion 406 comprises a top edge 412 that may be a curvilinear/concave edge whose highest point(s) 420*a* and 420*b* may be generally aligned with the top edge 414 of the first portion 404 and whose lowest point 422 may be aligned with a bottom edge 408 of the first portion 404. However, the depth of the top edge 412 may be varied depending on the size of the garment, the shape of the garment, whether the garment is unisex, whether the garment is for a male wearer, whether the garment is for a female wearer, whether the garment is for a child, young adult, and the like. For example, a child may feel more comfortable with a higher degree of coverage, while an adult athlete may feel more comfortable with a deeper (more curved) top edge 412. In other words, the concave shape of the top edge 412 of the second portion 406 may comprise a unique ergonomic shape to accommodate the abdomen of a wearer when the garment 400 is worn. In particular, when the wearer is engaged in physical activities requiring bending over, the concave shape of the top edge 412 may be configured to accommodate the abdomen of the wearer without cutting into the wearer's skin or rolling over thereby increasing the comfort for the wearer. Thus, the depth of the concave shape of the top edge 412 may be anatomically driven to prevent waistband discomfort.

Figure 4C:
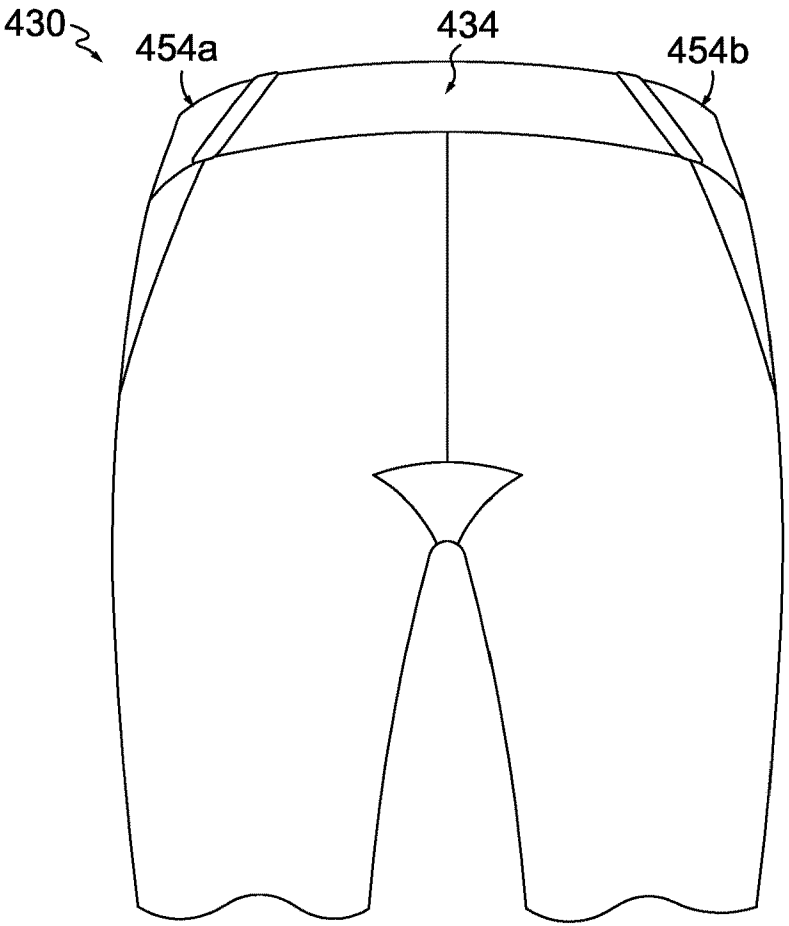
FIG. 4C depicts a partial back view of the lower body garment in FIG. 4B.
Figure 4B:
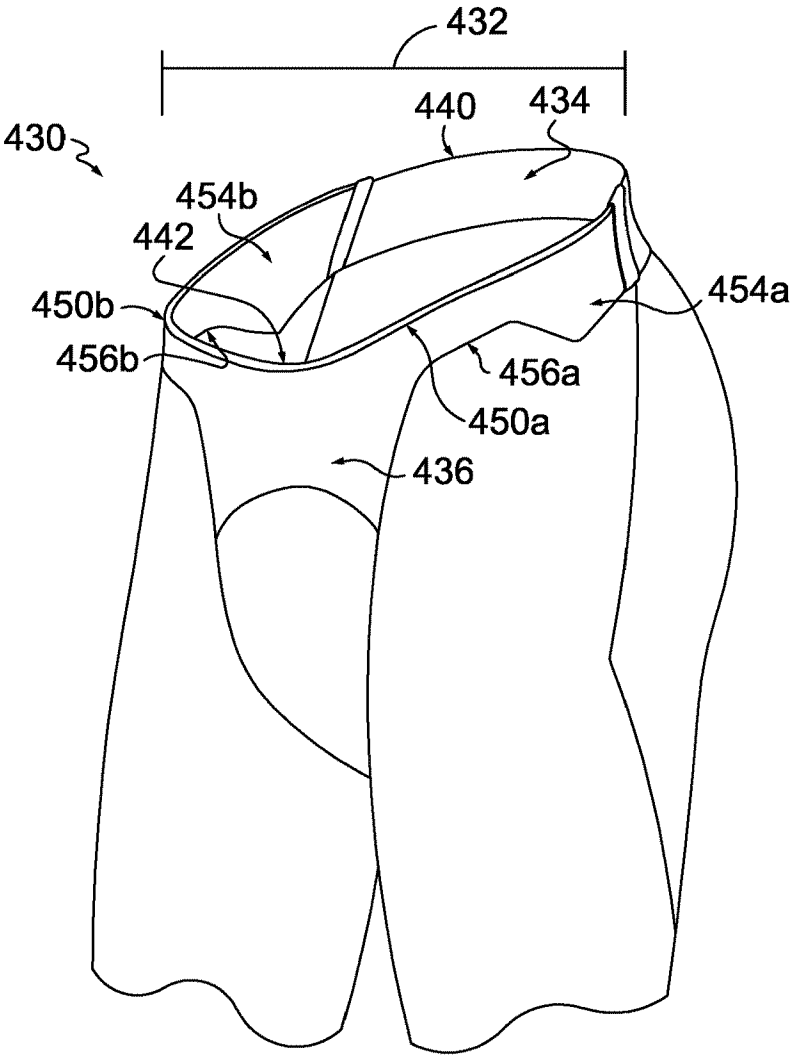
FIG. 4B depicts another exemplary lower body garment incorporating a waistband construct in accordance with aspects herein.

In FIG. 4B another exemplary garment 430 comprising a waistband construct in accordance with aspects herein is shown. Similar to the garment discussed above with reference to FIG. 1, the garment 430 generally comprises a waistband construct 432 comprising a first portion 434 configured to circumferentially extend around the back waist area of a wearer when the garment 430 is worn, and a second portion 436 configured to circumferentially extend around a front pelvic area of a wearer when the garment 430 is worn. In the garment 430, the first portion 434 may comprise a top edge 444 that may be straight throughout and the second portion 436 may comprise a top edge 442 that may be a straight or curvilinear/concave. In the case where the top edge 442 is curvilinear (as shown), the highest point(s) 450*a* and 450*b* may be generally aligned with a top edge 444 of the first portion 434 and the lowest point 452 may be aligned with a bottom edge 438 of the first portion 434. However, the depth of the top edge 442 may be varied depending on the size of the garment, the shape of the garment, whether the garment is unisex, whether the garment is for a male wearer, whether the garment is for a female wearer, whether the garment is for a child, young adult, and the like. For example, a child may feel more comfortable with a higher degree of coverage, while an adult athlete may feel more comfortable with a deeper (more curved) top edge 442. In other words, the concave shape of the top edge 442 of the second portion 436 may comprise a unique ergonomic shape to accommodate the abdomen of a wearer when the garment 430 is worn. In particular, when the wearer is engaged in physical activities requiring bending over, the concave shape of the top edge 442 may be configured to accommodate the abdomen of the wearer without cutting into the wearer's skin or rolling over thereby increasing the comfort for the wearer. Thus, the depth of the concave shape of the top edge 442 may be anatomically driven to prevent waistband discomfort. Furthermore, as shown, the second portion 436 of the waistband construct may be configured to extend beyond the abdominal area to wrap around a hip area of the wearer with elongated segments 454*a* and 454*b*. The shape of the elongated segments 454*a* and 454*b* may also be ergonomic and anatomically driven by providing, for example, indented portions 456*a* and 456*b* so that the second portion 436 does not interfere with a hip and leg mobility of the wearer, while still providing an increased support to the abdominal sides of the wearer, when the garment is worn.

In the exemplary garment of FIG. 4B, the elongated segments 454*a* and 454*b* may comprise the same layered construction as the rest of the second portion 436 having one or more middle panels of an elastomer/thermoplastic material with or without one or more voided portions. As described above, the voided portions when present, may serve to aid the breathability of the second portion 436. Additionally, the voided portions, when present, may aid in decreasing a modulus of elasticity of the second portion 436. Therefore, the voided portions in the one or more middle panels may be formed in different regions of the second portion 436 to take into account the amount of elasticity and the amount of support desired for different regions of the of the waistband construct 432 (i.e. the stretchability of the different regions of the second portion 436). The elongated segments 454*a* and 454*b* may extend any distance desired around the waistband construct 432. In some examples, the whole waistband construct may comprise the layered construction of the second portion 436. In other examples, the elongated segments 454*a* and 454*b* may partially extend toward a back portion of the garment 430, as shown in FIG. 4C, where a majority of the waistband construct 432 at the back portion of the garment 430 may comprise the first portion 434, or in other examples, the elongated segments 454*a* and 454*b*, may extend slightly beyond a hip area of a wearer when the garment 430 is in an as worn configuration.

Figure 5A:
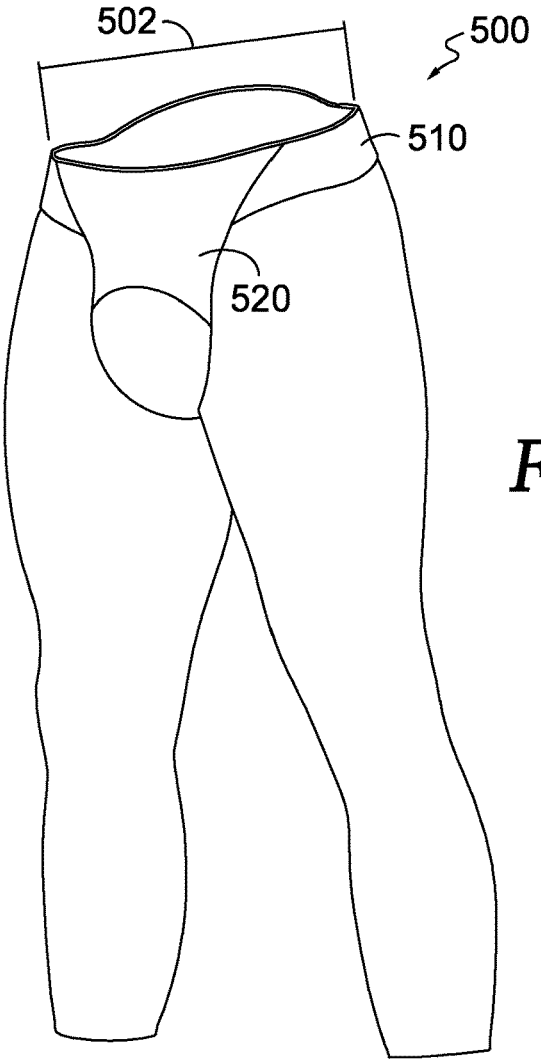
FIG. 5A depicts a front perspective view of an exemplary lower body garment incorporating a waistband construct in accordance with aspects herein.
Figure 5B:
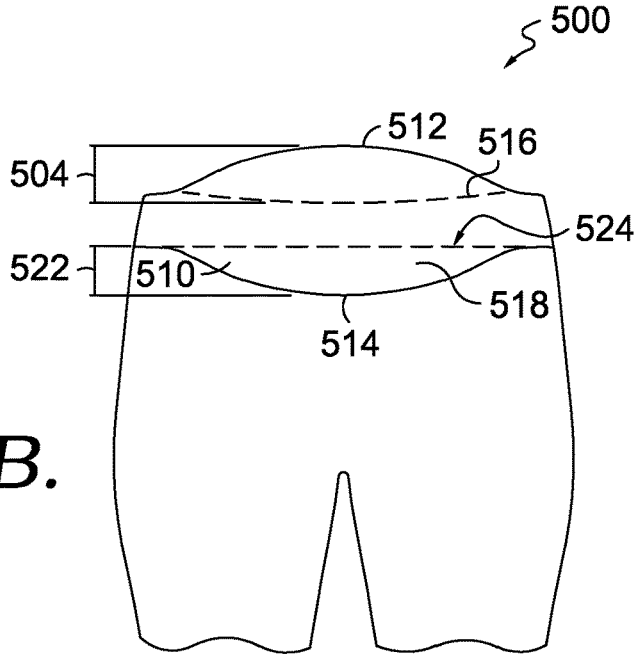
FIG. 5B depicts a partial back view of the lower body garment in FIG. 5A.

FIGS. 5A and 5B depict yet another example of a waistband construct 502 in accordance with aspects herein. The garment 500 in accordance with aspects herein comprises a first portion 510 and a second portion 520, where the second portion 520 may be constructed according to any of the examples described above with reference to FIGS. 2A-2C and FIG. 4. The first portion 510 of the garment 500 in accordance with aspects herein comprises a wider section 518 configured to circumferentially extend around a back torso area of the wearer, thereby providing a greater level of support to a wearer's spine when the garment 500 is worn. For example, the wider section 518 may be configured to extend a predetermined distance 504 higher than a top edge of a conventional waistband (as shown by dashed lines 516) to a top edge 512 of the wider section 518 and additionally, may also extend a predetermined distance 522 below a bottom edge of a conventional waistband (as shown by dashed lines 524) to a bottom edge 514 of the wider section 518 to offer an increased support to a lower back of a wearer when the garment 500 is worn by a wearer. In this configuration, the first portion 510 may be formed from a single panel of pliable material, or alternatively, the first portion 510 may be formed from two or more different panels of pliable material with the wider section 518 employing, for example, a more rigid pliable material than the rest of the first portion 510 of the waistband construct 502. The particular width of the wider section 518 may also be anatomically driven and it may be personalized according to particular preferences of a wearer since the anatomies may greatly differ from person to person.

Figure 5D:
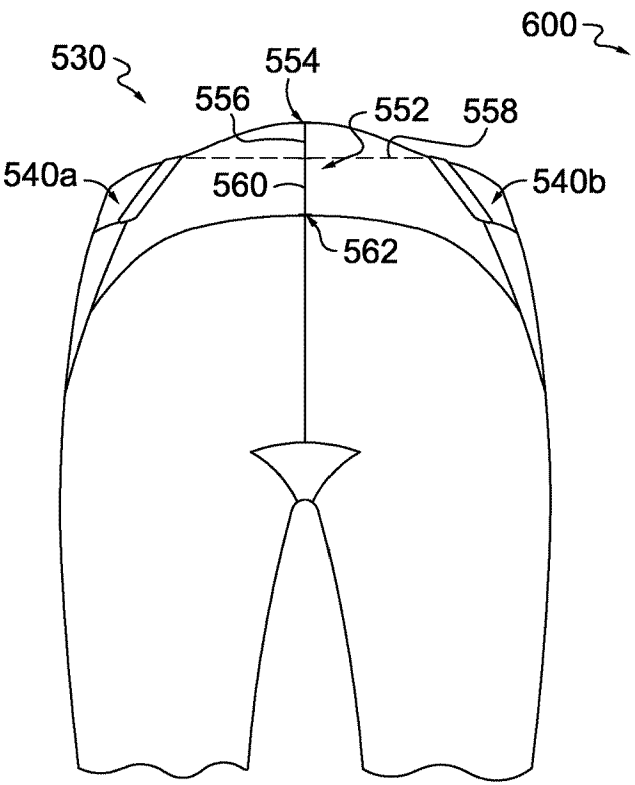
FIG. 5D depicts a partial back view of the lower body garment in FIG. 5C.
Figure 5C:
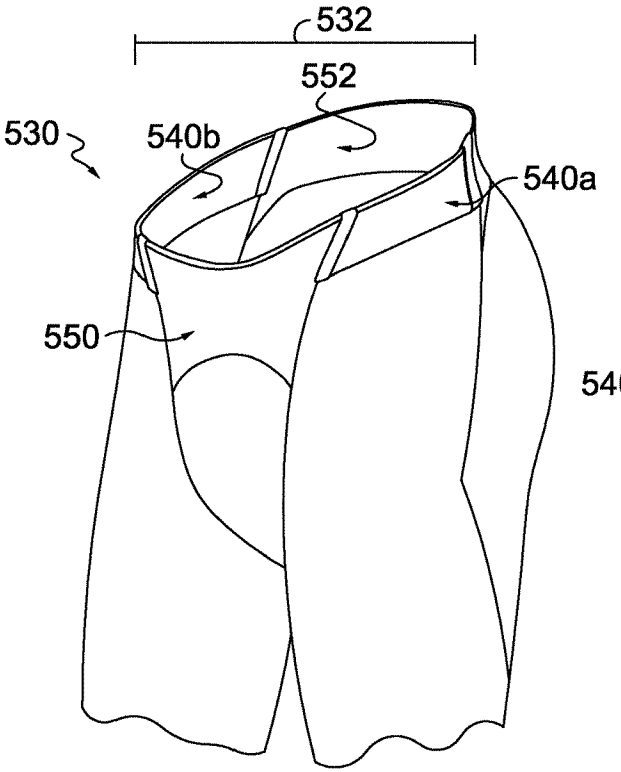
FIG. 5C depicts a front perspective view of another exemplary lower body garment incorporating a waistband construct in accordance with aspects herein.

FIGS. 5C and 5D depict yet another example of a waistband construct 532 in accordance with aspects herein. The garment 530 in accordance with aspects herein comprises a first portion 540*a* and 540*b* and a second portion 550, where the second portion 550 may be constructed according to any of the examples described above with reference to FIGS. 2A-2C and FIG. 4. Further, the waistband construct 532 in accordance herein may comprise a third portion 552 that may be wider than the first portion 540*a* and 540*b* and that may be configured to circumferentially extend around a back torso area of the wearer, thereby providing a greater level of support to a wearer's spine when the garment 530 is worn. For example, the wider third portion 552 may be configured to extend a predetermined distance 556 higher than a top edge of a conventional waistband (as shown by dashed lines 558) to a top edge 554 of the wider third portion 552. Additionally, the wider third portion 552 may also extend a predetermined distance 560 below the top edge of a conventional waistband (as shown by the dashed lines 558) to a bottom edge 562 of the wider third portion 552, where the bottom edge 562 may be curvilinear (as shown), angled, or straight, depending on the level of support desired and the location of the support desired. Another important aspect of the wider third portion 552, in accordance with aspects herein, is that the wider third portion 552 may also comprise a layered construction similar to the second portion 550 of the waistband construct 532. In other words, the wider third portion may be constructed in layers with one or more elastomer/thermoplastic middle layers to provide a desired level of rigidity and/or support to the wider third portion 552. The level of support may be adjusted by varying a number and/or thickness of the elastomer/thermoplastic middle layers provided, adjusting a number and/or size of voided portions in the elastomer/thermoplastic middle layers provided, or varying a different combination of these parameters. The particular width and rigidity of the wider third portion 552 may also be anatomically driven and it may be personalized according to particular preferences of a wearer since the anatomies may greatly differ from person to person.

Figure 6:
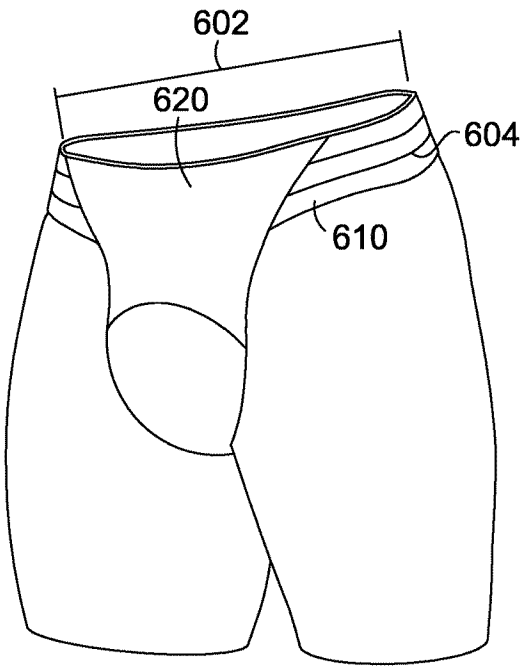
FIG. 6 depicts an exemplary lower body garment incorporating a waistband construct in accordance with aspects herein.

FIG. 6 depicts yet another exemplary garment 600 in accordance with aspects herein. The garment 600 may comprise any of the general configurations for the waistband construct as described above with reference to FIGS. 1-2C and FIGS. 4-5B. For instance, the waistband construct 602 may comprise a first portion 610 and a second portion 620. In addition to the features described above with reference to FIGS. 1-2C and FIGS. 4-5B, the first portion 610 of the waistband construct 602 may comprise one or more elastomer grip structures 604 on the outer surface of the first portion 610. The one or more elastomer grip structures 604 may be applied, for example, by a printing process, and may therefore, be applied as an array of dots, lines, different shapes, designs, and the like. The one or more elastomer grip structures 604 may be uniformly distributed on the outer surface of the first portion 610 and may serve to grip on to an upper body garment (not shown) when worn in conjunction with the garment 600. The elastomer grip structures 604, for example, may prevent constant shifting of an upper body garment relative to the garment 600, thereby, further increasing the comfort of a wearer since problems arising from the constant garment shifting due to movement, would be substantially reduced, and thus problems such as bunching up and the like would be prevented.

Figure 7:
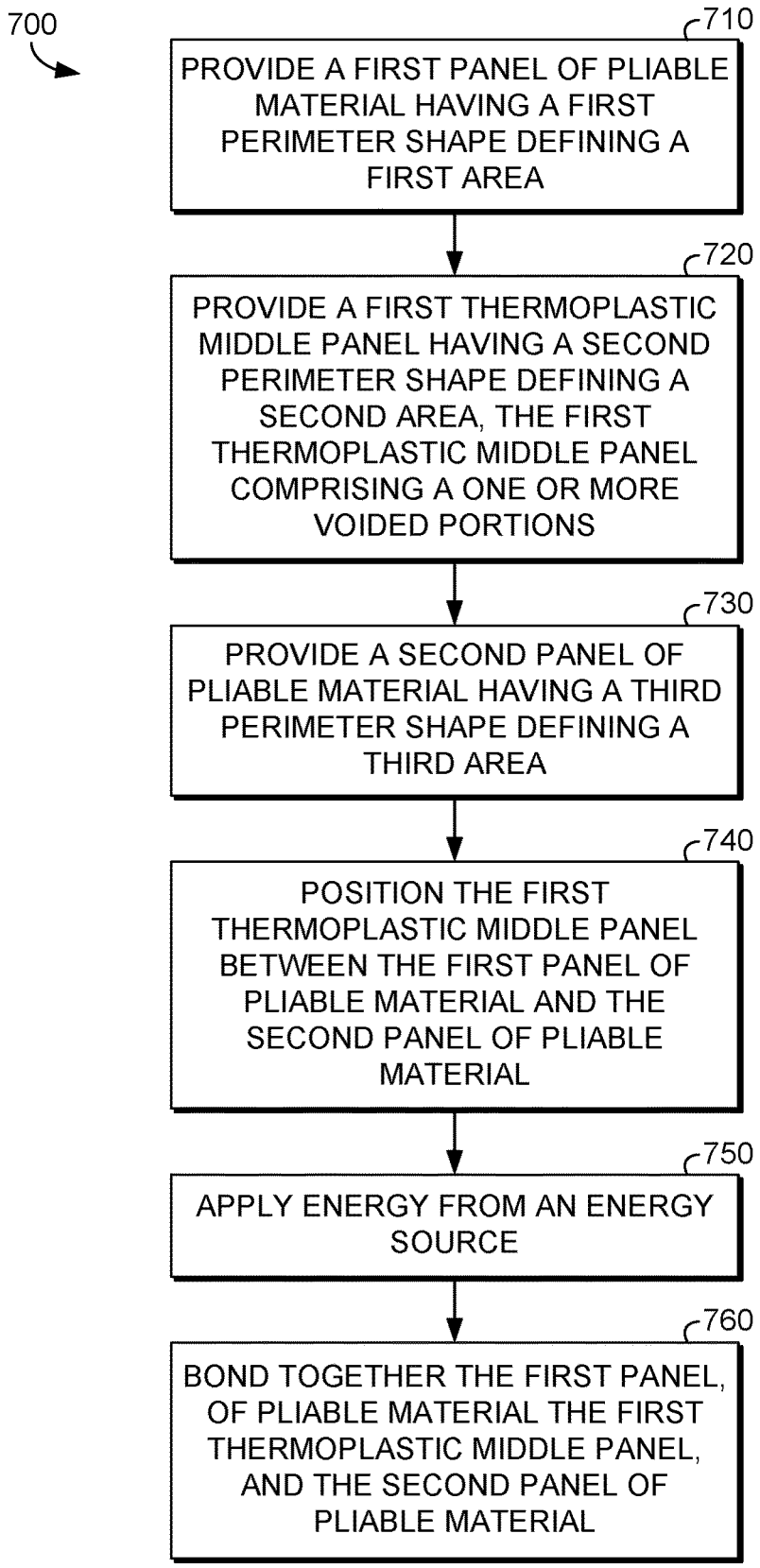
FIG. 7 depicts a flow chart outlining a method for constructing a waistband construct in accordance with aspects herein.

Moving on to FIG. 7, a schematic view of an exemplary method 700 of forming a support panel for a waistband construct in accordance with aspects herein is provided. In the exemplary method, a first panel of pliable material having a first perimeter shape defining a first area may be provided at step 710. At step 720, a first elastomer/thermoplastic middle panel having a second perimeter shape defining a second area and, optionally, one or more voided portions may be provided. Further, a second panel of pliable material having a third perimeter shape defining a third area may be provided as shown in step 730. Once the first panel of pliable material, the second panel of pliable material, and the first elastomer/thermoplastic middle panel are provided, the first elastomer/thermoplastic middle panel may be interposed or positioned between and first panel of pliable material and the second panel of pliable material, as shown at step 740. Once the three panels are aligned, energy may be applied to the three-layered panels to activate an adhesive applied to the first elastomer/thermoplastic middle panel and/or the adhesive properties of the first elastomer/thermoplastic middle panel, as shown at step 750. The energy may be in the form of heat energy, pressure energy, ultrasonic energy, and the like. The activation of the adhesive may result in the first panel of pliable material, the first elastomer/thermoplastic middle panel, and the second panel of pliable material being integrally bonded to each other, as shown at step 760. One thing to note is that the third perimeter shape of the second panel of pliable material may be, at least in part, larger than the first perimeter shape of the first panel of pliable material and the second perimeter shape of the first elastomer/thermoplastic middle panel so that at least a top edge of the second panel pliable material may be wrapped over a top edge the first panel of pliable material and the first elastomer/thermoplastic middle panel to form a sealed/covered top edge.

Figure 8:
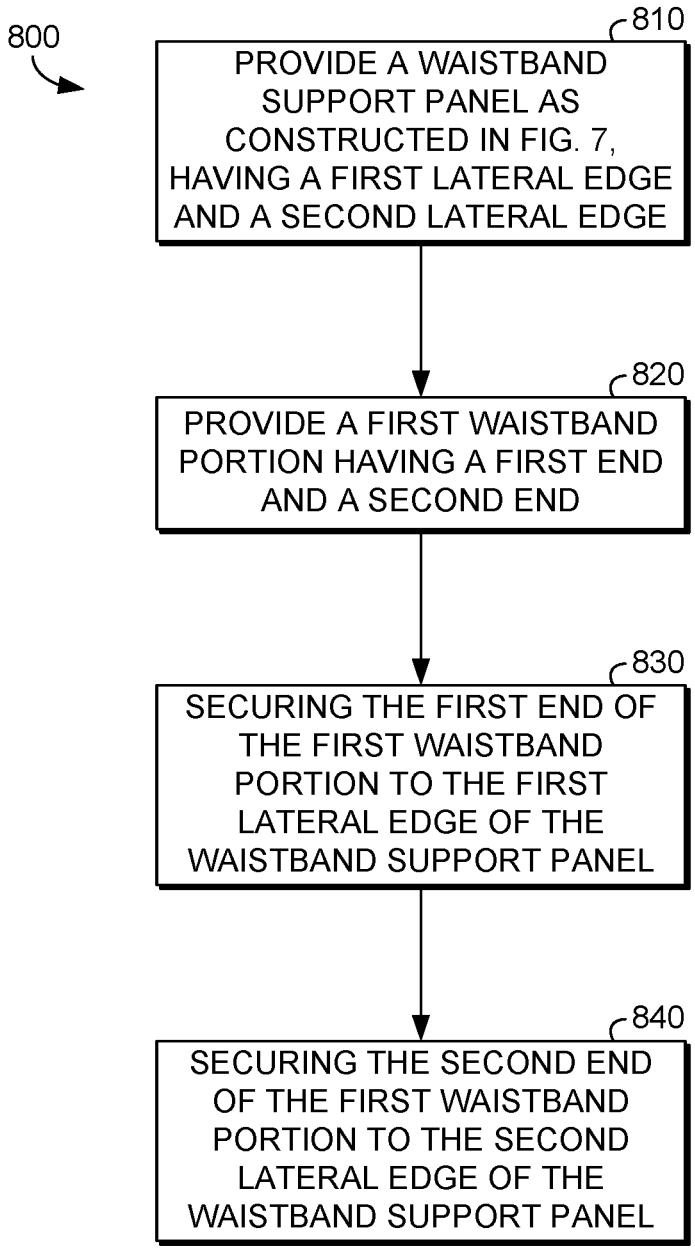
FIG. 8 depicts another flow chart outlining a method for constructing a waistband construct in accordance with aspects herein.

FIG. 8 depicts a schematic view of an exemplary method 800 of construction of a waistband construct in accordance with aspects herein is provided. In the exemplary method, a support panel as constructed above with reference to FIG. 7 may be provided at step 810. At step 820, a waistband portion having a first end and a second end may be provided. The first end of the waistband portion may be secured to a first edge of the support panel at step 830, and the second end may be secured to an opposite second edge of the support panel at step 840. As described above with reference to FIGS. 2A-2C, the waistband portion may be secured to the support panel in different ways that may involve stitching and/or adhesive bonding.

Figure 9:
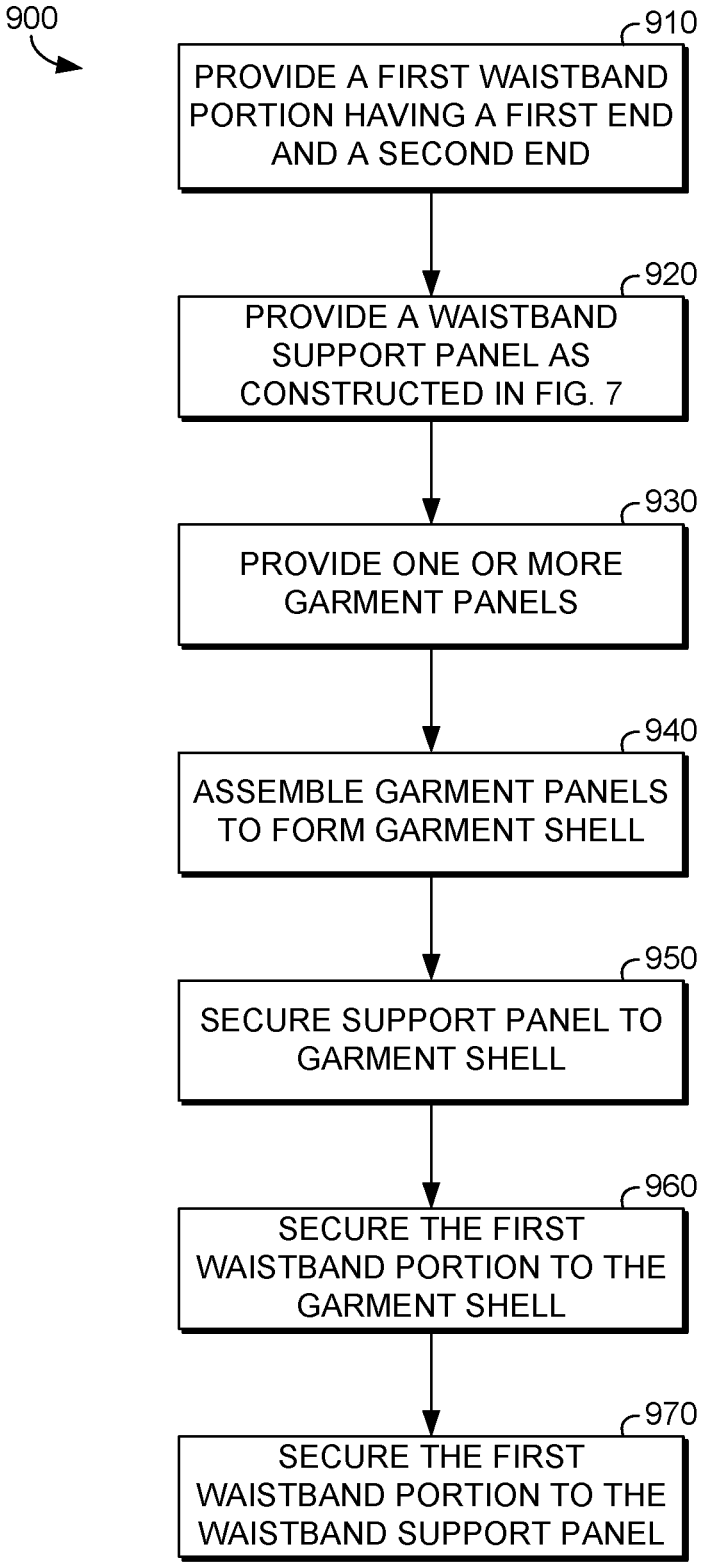
FIG. 9 depicts an additional flow chart outlining a method for constructing a garment with a waistband construct in accordance with aspects herein.

FIG. 9 depicts another schematic view of a method for constructing a garment with a waistband construct in accordance with aspects herein. The method may start by providing a waistband portion having a first end and a second end, as shown at step 910. Further, a support panel as constructed according to, for example, the method 700, is provided at step 920, and one or more garment panels may be provided, as shown at step 930. The one or more garment panels may be assembled to form a garment shell, as shown at step 940. Further, the support panel and the waistband portion may be secured to the garment shell as shown at steps 950 and 960, and the waistband portion may be secured to the support panel as shown at step 970.

It is to be noted that the sequence of steps shown in the methods described herein are merely exemplary and the steps shown herein are independent from each other and may be performed in different sequences/chronologies without departing from aspects herein. Further, there may be additional steps or fewer steps than those described herein for the construction of the waistband construct in accordance with aspects of the technology described herein.

Furthermore, although the first portion and the second portion of the waistband construct in accordance with aspects herein have been described above as being separate components, it is envisioned that the first portion and the second portion of the waistband construct may be engineered to be manufactured together as seamlessly adjacent pieces through, for example, a weaving or knitting process. In other words, the first portion and the second portion of the waistband construct may be manufactured as a single continuous piece of pliable material with one or more pocket(s) capable of receiving the elastomer/thermoplastic panels prior to their activation and bonding (e.g. by applying heat and/or ultrasonic energy). Alternatively, elastomer/thermoplastic coated yarns may be used to integrally weave or knit the middle panel(s) with the panels of pliable material enclosing the middle panel, which, upon exposure to energy, may bond all layers of a region designated as the support panel, and the like, for the waistband construct in accordance with aspects herein. Furthermore, it is also envisioned that the waistband construct in accordance with aspects herein may be integrally formed (seamlessly adjacent) with garment forming layers.

One of the objects of the technology described herein is to provide a garment that is comfortable and that provides support to an abdominal area/pelvic area of a wearer when the garment is worn. The garment in accordance with aspects herein is ergonomic providing different levels of support to different areas, of a wearer's abdominal/pelvic area. Although the garments depicted are lower body garments, it is envisioned that the technology in accordance with aspects herein could also be employed in body suits, by for example, adding an upper body portion to the lower body garments discussed herein. Further, as briefly discussed above, the garments with the waistband construct according to aspects herein, may be of any length, for example, footed pants, long pants, ankle pants, capri pants, below the knee pants, above the knee pants, short pants, extra short pants, and the like. Moreover, the construction of the support panel may be incorporated into other article of apparel such as, for example, an upper body garment (e.g., shirt), socks, shoes, hats, protective equipment (shin guards, pads, etc.), and the like.

The aspects described throughout this specification are intended in all respects to be illustrative rather than restrictive. Upon reading the present disclosure, alternative aspects will become apparent to ordinary skilled artisans that practice in areas relevant to the described aspects without departing from the scope of this disclosure. In addition, aspects of this technology are adapted to achieve certain features and possible advantages set forth throughout this disclosure, together with other advantages which are inherent. It will be understood that certain features and subcombinations are of utility and may be employed without reference to other features and subcombinations. This is contemplated by and is within the scope of the claims.

Since many different garment styles may be made of the invention without departing from the scope thereof, it is to be understood that all matter herein set forth or shown in the accompanying drawings is to be interpreted as illustrative and not in a limiting sense.

Having thus described the invention, what is claimed is:

1. A waistband construct for a garment, the waistband construct comprising:

a first portion having a first modulus of elasticity configured to circumferentially extend around at least a back portion of a wearer when the garment is in an as worn configuration, wherein the first portion comprises a first end and a second end; and a second portion having a second modulus of elasticity configured to, at least in part, circumferentially extend around a front portion of the wearer when the garment is in an as worn configuration, the second portion comprising:

(1) a first panel of pliable material, (2) a second panel of pliable material, and (3) at least a first thermoplastic middle panel positioned between the first panel of pliable material and the second panel of pliable material, wherein the first thermoplastic middle panel comprises a first plurality of voided portions;

wherein the first portion is secured to the second portion so that the first portion and the second portion circumferentially extend around a waist area of the wearer when the garment is in the as worn configuration.

2. The waistband construct of claim 1, wherein the second modulus of elasticity is greater than the first modulus of elasticity.

3. The waistband construct of claim 1, wherein the first portion is secured to the second portion by sewing the first end of the first portion to a first lateral edge of the second portion to form a first seam and sewing the second end of the first portion to a second lateral edge of the second portion to form a second seam.

4. The waistband construct of claim 3, wherein at least an interior surface of the first seam is covered by a first strip of material and at least an interior surface of the second seam is covered by a second strip of material, wherein the interior surface is configured to face the wearer when the garment is in the as worn configuration.

5. The waistband construct of claim 1, wherein the first portion is secured to the second portion by interposing and affixing the first end and the second end of the first portion between the first panel of pliable material and the second panel of pliable material of the second portion.

6. The waistband construct of claim 5, wherein the first portion comprises a first surface and a second surface opposite the first surface, and wherein the first end and the second end of the first portion are affixed to the second portion by providing an adhesive material on the first surface and the second surface of the first end and the second end of the first portion.

7. The waistband construct of claim 6, wherein the first surface is an interior surface configured to face the wearer when the garment is in the as worn configuration, and wherein the second surface is an exterior surface, and wherein the second surface further comprises one or more elastomer grip structures.

8. The waistband construct of claim 1, wherein each voided portion in the first plurality of voided portions is uniform in size and shape and is uniformly distributed throughout the first thermoplastic middle panel.

9. The waistband construct of claim 1, wherein one or more voided portions in the first plurality of voided portions comprise different sizes that form a size gradient of voided portions throughout the first thermoplastic middle panel.

10. The waistband construct of claim 1, wherein the first portion comprises a first width and the second portion comprises a second width, wherein the second width is greater than the first width.

11. The waistband construct of claim 1, wherein the second portion further comprises a second thermoplastic middle panel positioned between the first thermoplastic middle panel and the first panel of pliable material or, wherein the second thermoplastic middle panel is positioned between the second panel of pliable material and the first thermoplastic middle panel.

12. The waistband construct of claim 11, wherein the second thermoplastic middle panel is positioned adjacent to a top edge of the second portion, and wherein the second thermoplastic middle panel comprises a third width.

13. The waistband construct of claim 1, wherein a top edge of the second portion is a curvilinear edge.

14. The waistband construct of claim 12, wherein the second thermoplastic middle panel comprises a second plurality of voided portions.

* * * * *